US009181756B2

(12) United States Patent
Schwefe et al.

(10) Patent No.: US 9,181,756 B2
(45) Date of Patent: Nov. 10, 2015

(54) DRILL BIT WITH A FORCE APPLICATION USING A MOTOR AND SCREW MECHANISM FOR CONTROLLING EXTENSION OF A PAD IN THE DRILL BIT

(75) Inventors: Thorsten Schwefe, Virginia Water (GB); Dan Raz, Tirat Carmel (IL); Gregory Rinberg, Tirat Carmel (IL)

(73) Assignee: Baker Hughes Incorporated, Houston, TX (US)

( * ) Notice: Subject to any disclaimer, the term of this patent is extended or adjusted under 35 U.S.C. 154(b) by 416 days.

(21) Appl. No.: 13/561,897

(22) Filed: Jul. 30, 2012

(65) Prior Publication Data

US 2014/0027176 A1 Jan. 30, 2014

(51) Int. Cl.
*E21B 10/62* (2006.01)

(52) U.S. Cl.
CPC ..... *E21B 10/62* (2013.01)

(58) Field of Classification Search
CPC ..... E21B 10/62; E21B 4/04; E21B 4/006
USPC ..... 175/40, 57, 104
See application file for complete search history.

(56) References Cited

U.S. PATENT DOCUMENTS

| | | | | |
|---|---|---|---|---|
| 1,860,214 | A | 5/1932 | Yeaman | |
| 3,807,512 | A | 4/1974 | Pogonowski et al. | |
| 4,185,704 | A | 1/1980 | Nixon, Jr. | |
| 4,281,722 | A | 8/1981 | Tucker et al. | |
| 4,397,619 | A | 8/1983 | Alliquander et al. | |
| 4,549,614 | A | 10/1985 | Kaalstad et al. | |
| 4,676,310 | A | 6/1987 | Scherbatskoy et al. | |
| 4,940,097 | A | 7/1990 | Martini | |
| 5,582,260 | A | 12/1996 | Murer et al. | |
| 5,682,957 | A | 11/1997 | Lyon | |
| 5,971,085 | A | 10/1999 | Colebrook | |
| 7,004,263 | B2 | 2/2006 | Moriarty et al. | |
| 7,360,610 | B2 | 4/2008 | Hall et al. | |
| 7,389,832 | B2 * | 6/2008 | Hooper | 175/107 |
| 7,434,634 | B1 | 10/2008 | Hall et al. | |
| 7,451,835 | B1 | 11/2008 | Hall et al. | |
| 7,484,576 | B2 | 2/2009 | Hall et al. | |
| 7,506,701 | B2 | 3/2009 | Hall et al. | |
| 7,866,416 | B2 | 1/2011 | Hall et al. | |
| 8,011,457 | B2 * | 9/2011 | Hall et al. | 175/389 |
| 8,297,375 | B2 | 10/2012 | Hall et al. | |
| 2002/0179336 | A1 | 12/2002 | Schaaf et al. | |
| 2005/0247488 | A1 | 11/2005 | Mock et al. | |
| 2007/0114068 | A1 | 5/2007 | Hall et al. | |
| 2007/0181298 | A1 | 8/2007 | Sheiretov et al. | |
| 2008/0179098 | A1 | 7/2008 | Hall et al. | |

(Continued)

OTHER PUBLICATIONS

International Search Report and Written Opinion dated Oct. 23, 2013 for International Application No. PCT/US2013/052615.

(Continued)

*Primary Examiner* — Robert E Fuller
(74) *Attorney, Agent, or Firm* — Cantor Colburn LLP

(57) ABSTRACT

A drill bit and method of drilling a wellbore. The drill bit includes a pad configured to extend and retract from a surface of the drill bit, and a force application device configured to extend and retract the pad. The force application device includes a screw driven by an electric motor that linearly moves a drive unit to extend and retract the pad from the drill bit surface. The drill bit may be conveyed by a drill string and the pad may be extended from the drill bit face to drill the wellbore.

16 Claims, 4 Drawing Sheets

(56) References Cited

U.S. PATENT DOCUMENTS

| | | | | |
|---|---|---|---|---|
| 2008/0308318 | A1* | 12/2008 | Moore | 175/51 |
| 2009/0044979 | A1 | 2/2009 | Johnson et al. | |
| 2009/0057016 | A1 | 3/2009 | Hall et al. | |
| 2009/0107722 | A1 | 4/2009 | Chen et al. | |
| 2010/0071956 | A1 | 3/2010 | Beuershausen | |
| 2010/0212966 | A1 | 8/2010 | Hall et al. | |
| 2011/0031025 | A1 | 2/2011 | Kulkarni et al. | |
| 2011/0120775 | A1 | 5/2011 | Krueger et al. | |
| 2014/0027177 | A1 | 1/2014 | Schwefe et al. | |
| 2014/0027179 | A1* | 1/2014 | Schwefe et al. | 175/50 |
| 2014/0027180 | A1* | 1/2014 | Schwefe | 175/57 |

OTHER PUBLICATIONS

International Search Report and Written Opinion dated Oct. 25, 2013 for International Application No. PCT/US2013/052619.
International Search Report and Written Opinion dated Nov. 5, 2013 for International Application No. PCT/US2013/052621.
International Search Report and Written Opinion dated Oct. 23, 2013 for International Application No. PCT/US2013/052616.

* cited by examiner

DRILL BIT WITH A FORCE APPLICATION USING A MOTOR AND SCREW MECHANISM FOR CONTROLLING EXTENSION OF A PAD IN THE DRILL BIT

BACKGROUND INFORMATION

1. Field of the Disclosure

This disclosure relates generally to drill bits and systems that utilize same for drilling wellbores.

2. Background of the Art

Oil wells (also referred to as "wellbores" or "boreholes") are drilled with a drill string that includes a tubular member having a drilling assembly (also referred to as the "bottomhole assembly" or "BHA"). The BHA typically includes devices and sensors that provide information relating to a variety of parameters relating to the drilling operations ("drilling parameters"), behavior of the BHA ("BHA parameters") and parameters relating to the formation surrounding the wellbore ("formation parameters"). A drill bit attached to the bottom end of the BHA is rotated by rotating the drill string and/or by a drilling motor (also referred to as a "mud motor") in the BHA to disintegrate the rock formation to drill the wellbore. A large number of wellbores are drilled along contoured trajectories. For example, a single wellbore may include one or more vertical sections, deviated sections and horizontal sections through differing types of rock formations. When drilling progresses from a soft formation, such as sand, to a hard formation, such as shale, or vice versa, the rate of penetration (ROP) of the drill changes and can cause (decreases or increases) excessive fluctuations or vibration (lateral or torsional) in the drill bit. The ROP is typically controlled by controlling the weight-on-bit (WOB) and rotational speed (revolutions per minute or "RPM") of the drill bit so as to control drill bit fluctuations. The WOB is controlled by controlling the hook load at the surface and the RPM is controlled by controlling the drill string rotation at the surface and/or by controlling the drilling motor speed in the BHA. Controlling the drill bit fluctuations and ROP by such methods requires the drilling system or operator to take actions at the surface. The impact of such surface actions on the drill bit fluctuations is not substantially immediate. Drill bit aggressiveness contributes to the vibration, oscillation and the drill bit for a given WOB and drill bit rotational speed. Depth of cut of the drill bit is a contributing factor relating to the drill bit aggressiveness. Controlling the depth of cut can provide smoother borehole, avoid premature damage to the cutters and longer operating life of the drill bit.

The disclosure herein provides a drill bit and drilling systems using the same configured to control the aggressiveness of a drill bit during drilling of a wellbore.

SUMMARY

In one aspect, a drill bit is disclosed that in one embodiment includes a pad configured to extend and retract from a surface of the drill bit, and a force application device configured to extend and retract the pad, wherein the force application device includes a screw driven by an electric motor that linearly moves a drive unit to extend and retract the pad from the drill bit surface.

In another aspect, a method of drilling a wellbore is provided that in one embodiment includes: conveying a drill string having a drill bit at an end thereof, wherein the drill bit includes a pad configured to extend and retract from a surface of the drill bit and a force application device configured to extend and retract the pad, wherein the force application device includes a screw driven by an electric motor that moves a drive unit to extend the pad from the drill bit face; and rotating the drill bit to drill the wellbore.

Examples of certain features of the apparatus and method disclosed herein are summarized rather broadly in order that the detailed description thereof that follows may be better understood. There are, of course, additional features of the apparatus and method disclosed hereinafter that will form the subject of the claims appended hereto.

BRIEF DESCRIPTION OF THE DRAWINGS

The disclosure herein is best understood with reference to the accompanying figures in which like numerals have generally been assigned to like elements and in which.

DESCRIPTION OF THE EMBODIMENTS

Figure 1:
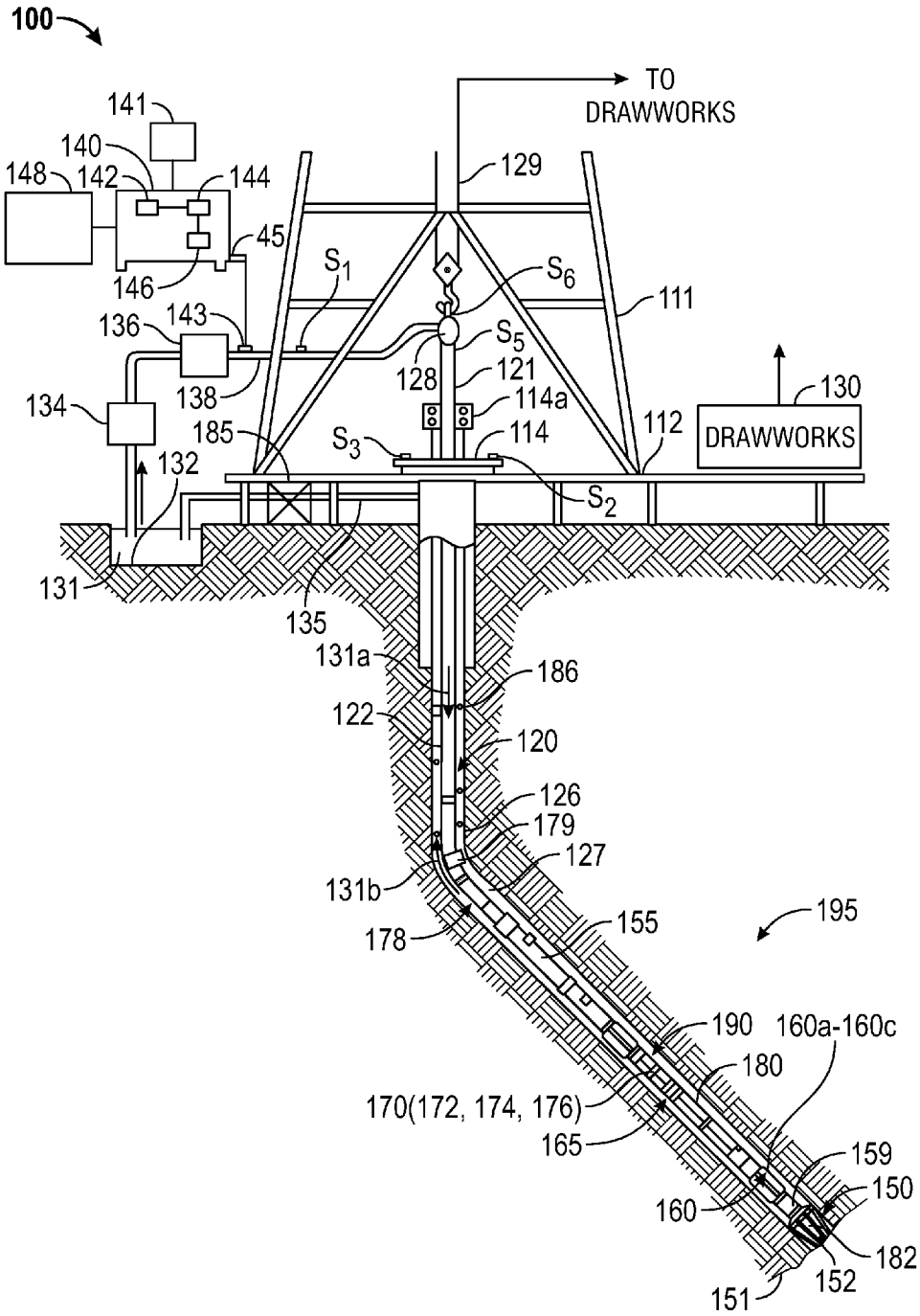
FIG. 1 is a schematic diagram of an exemplary drilling system that includes a drill string that has a drill bit made according to one embodiment of the disclosure.

FIG. 1 is a schematic diagram of an exemplary drilling system 100 that includes a drill string 120 having a drilling assembly or a bottomhole assembly 190 attached to its bottom end. Drill string 120 is shown conveyed in a borehole 126 formed in a formation 195. The drilling system 100 includes a conventional derrick 111 erected on a platform or floor 112 that supports a rotary table 114 that is rotated by a prime mover, such as an electric motor (not shown), at a desired rotational speed. A tubing (such as jointed drill pipe) 122, having the drilling assembly 190 attached at its bottom end, extends from the surface to the bottom 151 of the borehole 126. A drill bit 150, attached to the drilling assembly 190, disintegrates the geological formation 195. The drill string 120 is coupled to a draw works 130 via a Kelly joint 121, swivel 128 and line 129 through a pulley. Draw works 130 is operated to control the weight on bit ("WOB"). The drill string 120 may be rotated by a top drive 114*a* rather than the prime mover and the rotary table 114.

To drill the wellbore 126, a suitable drilling fluid 131 (also referred to as the "mud") from a source 132 thereof, such as a mud pit, is circulated under pressure through the drill string 120 by a mud pump 134. The drilling fluid 131 passes from the mud pump 134 into the drill string 120 via a desurger 136 and the fluid line 138. The drilling fluid 131*a* discharges at the borehole bottom 151 through openings in the drill bit 150. The returning drilling fluid 131*b* circulates uphole through the annular space or annulus 127 between the drill string 120 and the borehole 126 and returns to the mud pit 132 via a return line 135 and a screen 185 that removes the drill cuttings from the returning drilling fluid 131*b*. A sensor $S_1$ in line 138 provides information about the fluid flow rate of the fluid 131. Surface torque sensor $S_2$ and a sensor $S_3$ associated with the drill string 120 provide information about the torque and the rotational speed of the drill string 120. Rate of penetration of the drill string 120 may be determined from sensor $S_5$, while the sensor $S_6$ may provide the hook load of the drill string 120.

In some applications, the drill bit 150 is rotated by rotating the drill pipe 122. However, in other applications, a downhole motor 155 (mud motor) disposed in the drilling assembly 190 rotates the drill bit 150 alone or in addition to the drill string rotation. A surface control unit or controller 140 receives: signals from the downhole sensors and devices via a sensor 143 placed in the fluid line 138; and signals from sensors $S_1$-$S_6$ and other sensors used in the system 100 and processes such signals according to programmed instructions provided to the surface control unit 140. The surface control unit 140 displays desired drilling parameters and other information on a display/monitor 141 for the operator. The surface control unit 140 may be a computer-based unit that may include a processor 142 (such as a microprocessor), a storage device 144, such as a solid-state memory, tape or hard disc, and one or more computer programs 146 in the storage device 144 that are accessible to the processor 142 for executing instructions contained in such programs. The surface control unit 140 may further communicate with a remote control unit 148. The surface control unit 140 may process data relating to the drilling operations, data from the sensors and devices on the surface, data received from downhole devices and may control one or more operations drilling operations.

The drilling assembly 190 may also contain formation evaluation sensors or devices (also referred to as measurement-while-drilling (MWD) or logging-while-drilling (LWD) sensors) for providing various properties of interest, such as resistivity, density, porosity, permeability, acoustic properties, nuclear-magnetic resonance properties, corrosive properties of the fluids or the formation, salt or saline content, and other selected properties of the formation 195 surrounding the drilling assembly 190. Such sensors are generally known in the art and for convenience are collectively denoted herein by numeral 165. The drilling assembly 190 may further include a variety of other sensors and communication devices 159 for controlling and/or determining one or more functions and properties of the drilling assembly 190 (including, but not limited to, velocity, vibration, bending moment, acceleration, oscillation, whirl, and stick-slip) and drilling operating parameters, including, but not limited to, weight-on-bit, fluid flow rate, and rotational speed of the drilling assembly.

Still referring to FIG. 1, the drill string 120 further includes a power generation device 178 configured to provide electrical power or energy, such as current, to sensors 165, devices 159 and other devices. Power generation device 178 may be located in the drilling assembly 190 or drill string 120. The drilling assembly 190 further includes a steering device 160 that includes steering members (also referred to a force application members) 160*a*, 160*b*, 160*c* that may be configured to independently apply force on the borehole 126 to steer the drill bit along any particular direction. A control unit 170 processes data from downhole sensors and controls operation of various downhole devices. The control unit includes a processor 172, such as microprocessor, a data storage device 174, such as a solid-state memory and programs 176 stored in the data storage device 174 and accessible to the processor 172. A suitable telemetry unit 179 provides two-way signal and data communication between the control units 140 and 170.

During drilling of the wellbore 126, it is desirable to control aggressiveness of the drill bit to drill smoother boreholes, avoid damage to the drill bit and improve drilling efficiency. To reduce axial aggressiveness of the drill bit 150, the drill bit is provided with one or more pads 180 configured to extend and retract from the drill bit face 152. A force application unit 185 in the drill bit adjusts the extension of the one or more pads 180, which pads controls the depth of cut of the cutters on the drill bit face, thereby controlling the axial aggressiveness of the drill bit 150.

Figure 2:
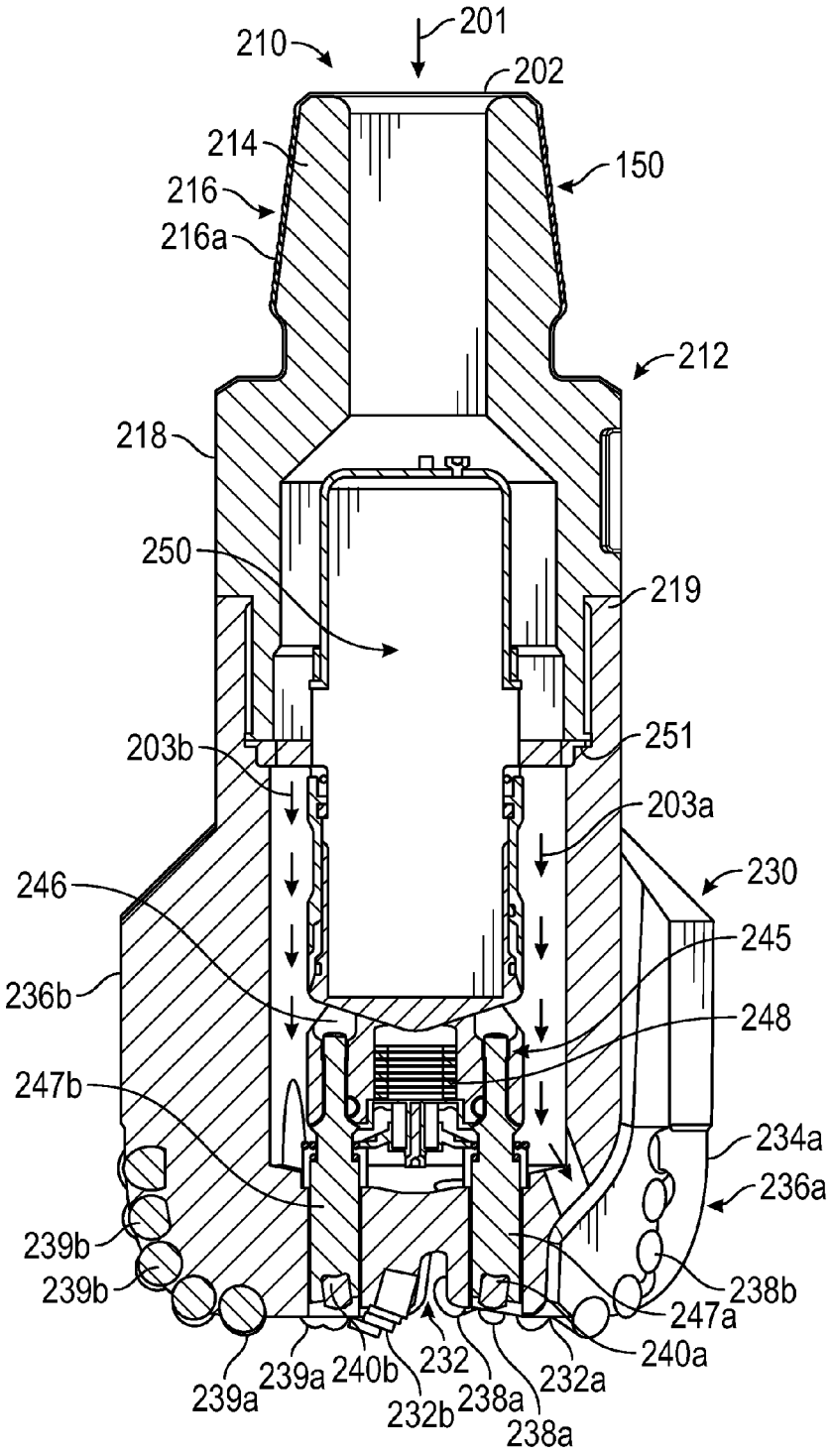
FIG. 2 shows a cross-section of an exemplary drill bit with a force application unit therein for extending and retracting pads on a surface of the drill bit, according to one embodiment of the disclosure.

FIG. 2 shows a cross-section of an exemplary drill bit 150 made according to one embodiment of the disclosure. The drill bit 150 shown is a polycrystalline diamond compact (PDC) bit having a bit body 210 that includes a shank 212 and a crown 230. The shank 212 includes a neck or neck section 214 that has a tapered threaded upper end 216 having threads 216*a* thereon for connecting the drill bit 150 to a box end at the end of the drilling assembly 130 (FIG. 1). The shank 212 has a lower vertical or straight section 218. The shank 210 is fixedly connected to the crown 230 at joint 219. The crown 230 includes a face or face section 232 that faces the formation during drilling. The crown includes a number of blades, such as blades 234*a* and 234*b*, each n. Each blade has a number of cutters, such as cutters 236 on blade 234*a* at blade having a face section and a side section. For example, blade 234*a* has a face section 232*a* and a side section 236*a* while blade 234*b* has a face section 232*b* and side section 236*b*. Each blade further includes a number of cutters. In the particular embodiment of FIG. 2, blade 234*a* is shown to include cutters 238*a* on the face section 232*a* and cutters 238*b* on the side section 236*a* while blade 234*b* is shown to include cutters 239*a* on face 232*b* and cutters 239*b* on side 236*b*. The drill bit 150 further includes one or more pads, such as pads 240*a* and 240*b*, each configured to extend and retract relative to the surface 232. In one aspect, a drive unit or mechanism 245 may carry the pads 240*a* and 240*b*. In the particular configuration shown in FIG. 2, drive unit 245 is mounted inside the drill bit 150 and includes a holder 246 having a pair of movable members 247*a* and 247*b*. The member 247*a* has the pad 240*a* attached at the bottom of the member 247*a* and pad 240*b* at the bottom of member 247*b*. A force application device 250 placed in the drill bit 150 causes the rubbing block 245 to move up and down, thereby extending and retracting the members 247*a* and 247*b* and thus the pads 240*a* and 240*b* relative to the bit surface 232. In one configuration, the force application device 250 may be made as a unit or module and attached to the drill bit inside via flange 251 at the shank bottom 217. A shock absorber 248, such as a spring unit, is provided to absorb shocks on the members 247*a* and 247*b* caused by the changing weight on the drill bit 150 during drilling of a wellbore. The spring 248 also may act as biasing member that causes the pads to move up when force is removed from the rubbing block 245. During drilling, a drilling fluid 201 flows from the drilling assembly into a fluid passage 202 in the center of the drill bit and discharges at the bottom of the drill bit via fluid passages, such as passages 203*a*, 203*b*, etc. A particular embodiment of a force application device, such as device 250, is described in more detail in reference to FIGS. 3-4.

Figure 3:
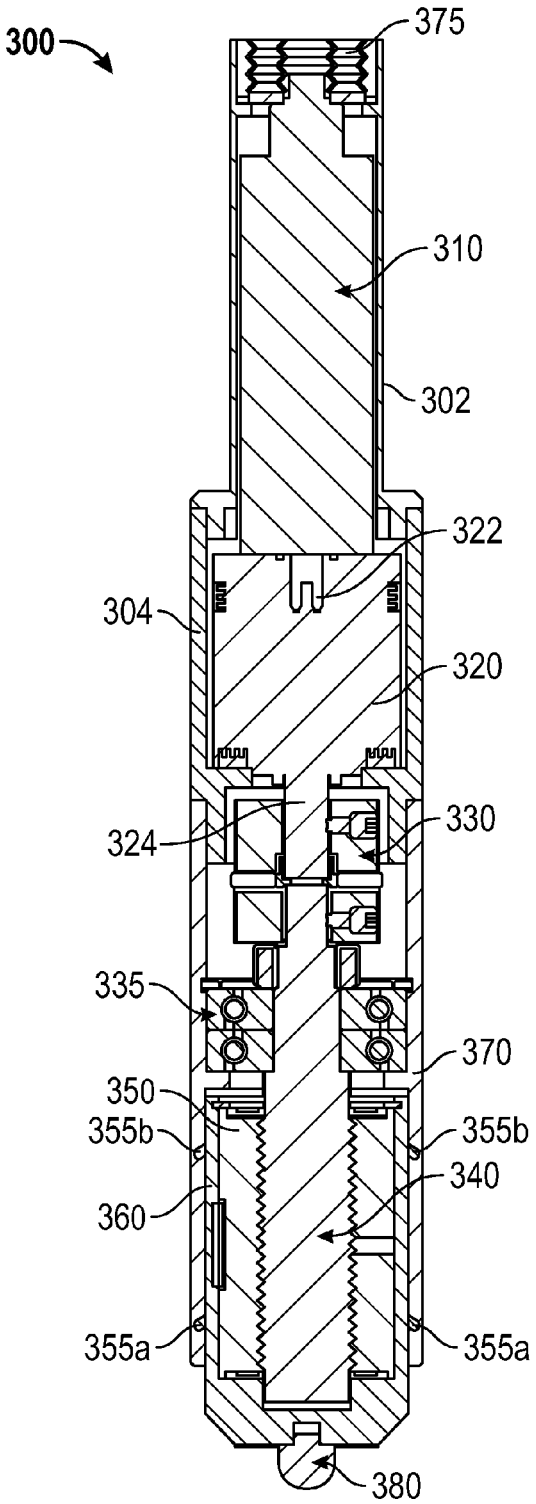
FIG. 3 is a cross-section of a force application device according to one embodiment of the disclosure.

FIG. 3 shows a cross-section of a force application device 300 made according an embodiment of the disclosure. In one aspect, the device 300 may be made in the form of a unit or capsule for placement in the fluid channel of a drill bit, such as drill bit 150 shown in FIG. 2. The device 300 may also be made in any number of subassemblies or components. The device 300 shown includes an upper chamber 302 that houses an electric motor 310 that may be operated by a battery (not shown) in the drill bit or by electric power generated by a power unit in the drilling assembly, such as the power unit 179 shown in FIG. 1. The electric motor 310 is coupled to a rotation reduction device 320, such as a reduction gear, via a coupling 322. The reduction gear 320 housed in a housing 304 rotates a drive shaft 324 attached to the reduction gear 320 at rotational speed lower than the rotational speed of the motor 310 by a known factor. The drive shaft 324 may be coupled to or decoupled from a rotational drive member 340, such as a drive screw, by a coupling device 330. In aspects, the coupling device 330 may be operated by electrical current supplied from a battery in the drill bit (not shown) or a power generation unit, such as power generation unit 179 in the drilling assembly 130 shown in FIG. 1. In one configuration, when no current is supplied to the coupling device 330, it is in a deactivated mode and does not couple the drive shaft 324 to the drive screw 340. When the coupling device 330 is activated by supplying current thereto, it couples or connects the drive shaft 324 to the drive screw 340. When the motor 310 is rotated in a first direction, for example clockwise, when the drive shaft 324 and the drive screw 340 are coupled by the coupling device 330, the drive shaft 324 will rotate the drive screw 340 in a first rotational direction, e.g., clockwise. When the current to the motor 310 is reversed when the drive shaft 324 is coupled to the drive screw 340, the drive screw 340 will rotate in a second direction, i.e., in this case opposite to the first direction, i.e., counterclockwise. The force application device 300 may further include a drive member 350, such as a nut, in a chamber 360, that is coupled to the drive screw 340 so that when the drive screw 340 rotates in one direction, the nut 350 moves linearly in a first direction (for example downward) and when the drive screw 340 moves in a second direction (opposite to the first direction), the nut 350 moves in a second direction, i.e., in this case upward. The nut 350 is connected to a pin member or pusher 380. The pin member 380 moves upward when the nut 340 moves upward and moves downward when the nut 340 moves downward. Bearings 335 may be provided around the drive screw 340 to provide lateral support to the drive screw 340. Seals 355*a* and 355*b*, such as o-rings, may be placed between the nut 350 and a housing 370 enclosing the chamber 360. The pin 380 is configured to apply force on the drive unit, such as drive unit 245 shown in FIG. 2. When the nut 380 moves downward, the pin 380 causes the pads 240*a* and 240*b* (FIG. 2) to extend from the drill bit surface and when the pin 380 moves upward, the biasing member in the drive unit 245 causes the pads 240*a* and 240*b* to retract from the drill bit surface. A pressure compensator 375, such as bellows may be provided to provide pressure compensation to the electric motor 310 and other components in the force application device 300.

Figure 4:
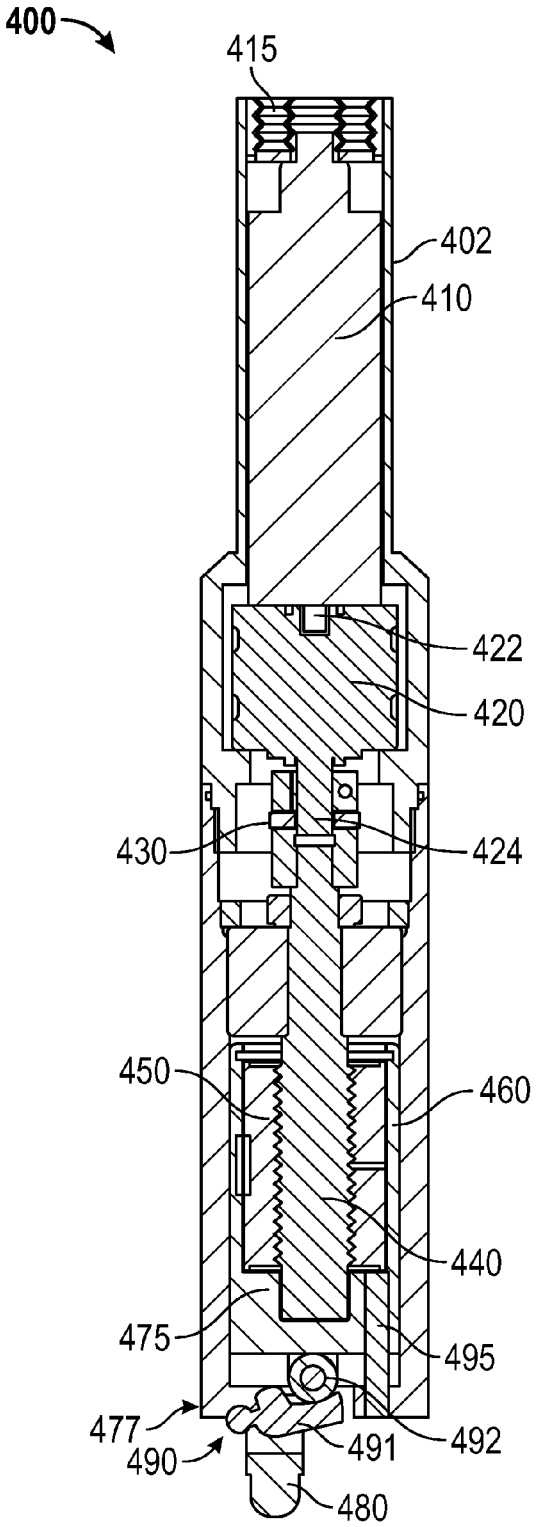
FIG. 4 shows a force application device similar to device shown in FIG. 3 that includes an alternative drive unit for moving the pin that moves the pads.

FIG. 4 shows a cross-section of a force application device 400 similar to the device 300 shown in FIG. 3, but includes an alternative drive unit 490 for moving the pin 480. The force application device 400 may be made in the form of a unit or capsule for placement in the fluid channel of a drill bit, such as drill bit 150 shown in FIG. 2. The device 400 includes an upper chamber 402 that houses an electric motor 410 that may be operated by a battery (not shown) in the drill bit or by electric power generated by a power unit in the drilling assembly, such as the power unit 179 shown in FIG. 1. The electric motor 410 is coupled to a rotation reduction device 420, such as a reduction gear, via a coupling 422. The reduction gear 420 rotates a drive shaft 424 attached to the reduction gear 420 at a rotational speed lower than the rotational speed of the motor 410 by a known factor. The drive shaft 424 may be coupled to or decoupled from a rotational drive member 440, such as a drive screw, by a coupling device 430, which coupling device may be operated by electrical current supplied from the battery in the drill bit (not shown) or a power generation unit, such as power generation unit 179 in the drilling assembly 130 (FIG. 1). When no current is supplied to the coupling device 430, it is in a deactivated mode and does not couple the drive shaft 424 to the drive screw 440. When the coupling device 430 is activated by supplying current thereto, it couples or connects the drive shaft 424 to the drive screw 440. When the motor 410 is rotated in a first direction, for example clockwise, when the drive shaft 424 and the drive screw 440 are coupled by the coupling device 430, the drive shaft 424 will rotate the drive screw 440 in a first rotational direction, e.g., in this case clockwise. When the current to the motor 410 is reversed when the drive shaft 424 is coupled to the drive screw 440, the drive screw 440 will rotate in a second direction, i.e., in this case opposite to the first direction, i.e., counterclockwise. The force application device 400 further includes a drive member 450, such as a nut, in a chamber 460, that is coupled to the drive screw 440 so that when the drive screw 440 rotates in one direction, the nut 450 moves linearly in a first direction (for example downward) and when the drive screw 440 moves in a second direction (opposite to the first direction), the nut 450 moves in a second direction, i.e., in this case upward. The nut 450 drives a shaft 475 that in turn drives a drive mechanism 490. The drive mechanism 490 includes a lever member 491 connected to an extension member 477 of the shaft 475 by a coupling member 492, such as a pin or another suitable attachment member. The lever 491 is connected to the pin member 480 in a manner that when the shaft 475 moves downward, it moves the lever downward that in turn causes the pin 480 to move downward. When the shaft 475 moves upward, the lever 491 moves upward and causes the pin 480 to move upward. In an alternative lever and pin configuration, an upward movement of the shaft may cause the pin 480 to move downward and a downward movement of the shaft may cause the pin 480 to move upward. A sensor 495 may be attached to the shaft 475 or placed at another suitable location to provide signals relating to the linear movement of the pin shaft 475 and thus the pin 480. The sensor may be any suitable sensor configured to provide signals relative to the motion of the pin. The sensor 395 may include, but is not limited to, a hall-effect sensor and a linear potentiometer sensor. The sensor 495 signals are processed by electrical circuits in the drill bit or in the drilling assembly and a controller in response thereto may control the motor rotation and thus the movement of the pin 480 and the pads. A pressure compensation device 315, such as bellows, may be provided to provide pressure compensation to the motor electric 410 and other components in the force application device 400.

The concepts and embodiments described herein are useful to control the axial aggressiveness of drill bits, such as a PDC bits, on demand during drilling. Such drill bits aid in: (a) steerability of the bit (b) dampening the level of vibrations and (c) reducing the severity of stick-slip while drilling, among other aspects. Moving the pads up and down changes the drilling characteristic of the bit. The electrical power may be provided from batteries in the drill bit or a power unit in the drilling assembly. A controller may control the operation of the motor and thus the extension and retraction of the pads in response to a parameter of interest or an event, including but not limited to vibration levels, torsional oscillations, high torque values; stick slip, and lateral movement.

The foregoing disclosure is directed to certain specific embodiments for ease of explanation. Various changes and modifications to such embodiments, however, will be apparent to those skilled in the art. It is intended that all such changes and modifications within the scope and spirit of the appended claims be embraced by the disclosure herein.

The invention claimed is:

1. A drill bit, comprising:

a pad configured to extend and retract from a surface of the drill bit; and a force application device configured to extend the pad from the surface of the drill bit, the force application device including:

an electric motor that rotates a drive screw;

a drive nut coupled to the drive screw, wherein the drive screw rotation in a first direction causes the drive nut to move in a first linear direction and rotation of the drive screw in a second direction causes the drive nut to move in a second linear direction; and a drive shaft coupled to the drive nut configured to exert force on the pad to extend the pad from the surface of the drill bit, wherein the drive shaft exerts force on a lever that applies force on a drive unit to cause the drive unit to extend the pad from the surface of the drill bit.

2. The drill bit of claim 1 further comprising a speed reduction device between the motor and the drive screw configured to reduce the rotation speed of the drive screw below the rotation speed of the motor.

3. The drill bit of claim 1 further comprising a bearing device configured to provide lateral support to the drive screw.

4. The drill bit of claim 1 further comprising a bellows configured to provide pressure balance between a component in the force application device and an element outside the force application device.

5. The drill bit of claim 1, wherein the drive unit includes a biasing device configured to cause the pad to retract into the drill bit when the force exerted on the pad is removed.

6. The drill bit of claim 1 further comprising a sensor configured to provide signals corresponding to movement relating to movement of the pad.

7. A drilling apparatus comprising:

a drilling assembly having a drill bit at end thereof, the drill bit comprising:

a pad configured to extend and retract from a surface of the drill bit; and a force application device configured to extend the pad from the surface of the drill bit, the force application device including:

an electric motor that rotates a drive screw;

a drive nut coupled to the drive screw, wherein the drive screw rotation in a first direction causes the drive nut to move in a first linear direction and rotation of the drive screw in a second direction causes the drive nut to move in a second linear direction; and a drive shaft coupled to the drive nut configured to exert force on the pad to extend the pad from the surface of the drill bit, wherein the drive shaft exerts force on a lever that applies force on a drive unit to cause the drive unit to extend the pad from the surface of the drill bit.

8. The drilling apparatus of claim 7 further comprising a sensor configured to provide signals related to a motion of the pad.

9. The drilling apparatus of claim 8 further comprising a controller configured to control rotation of the motor in response a parameter of interest.

10. The drilling apparatus of claim 9, wherein the parameter of interest is selected from a group consisting of: (i) aggressiveness of the drill bit; (ii) vibration; (iii) stick-slip; (iv) lateral movement of the drill bit; and (v) steerabilty of the drill bit.

11. The drilling apparatus of claim 9, wherein the controller is placed at a location selected from a group of locations consisting of: (i) in the drill bit; (ii) in the drilling assembly; (iii) at the surface; and (iv) partially at two or more of the drill bit, drilling assembly and the surface.

12. The drilling apparatus of claim 7 further comprising a speed reduction device between the motor and the drive screw configured to reduce the rotation speed of the drive screw below the rotation speed of the motor.

13. The drill bit of claim 1 further comprising a pressure compensation device configured to provide pressure balance between a component in the force application device and an element outside the force application device.

14. The drilling apparatus of claim 7 further comprising a drive unit between the force application device and the pad configured to move the pad to retract into the drill bit when the force exerted on the pad is removed.

15. A method of making a drill bit comprising:

providing a bit body having a pad configured to extend from a surface thereof;

providing a force application device that includes an electric motor that rotates a drive screw, a drive nut coupled to the drive screw, wherein the drive screw rotation in a first direction causes the drive nut to move in a first linear direction and rotation of the drive screw in a second direction causes the drive nut to move in a second linear direction, and a drive shaft coupled to the drive nut configured to exert force on the pad to extend the pad from the surface of the drill bit, wherein the drive shaft exerts force on a lever that applies force on a drive unit to cause the drive unit to extend the pad from the surface of the drill bit; and securely placing the force application device inside the drill bit body.

16. A method of drilling a wellbore, comprising:

conveying a drill string having a drill bit at an end thereof, wherein the drill bit includes a pad configured to extend and retract from a surface of the drill bit, and a force application device configured to extend the pad from the surface of the drill bit, the force application device including: an electric motor that rotates a drive screw, a drive nut coupled to the drive screw, wherein the drive screw rotation in a first direction causes the drive nut to move in a first linear direction and rotation of the drive screw in a second direction causes the drive nut to move in a second linear direction, and a drive shaft coupled to the drive nut configured to exert force on the pad to extend the pad from the surface of the drill bit, wherein the drive shaft exerts force on a lever that applies force on a drive unit to cause the drive unit to extend the pad from the surface of the drill bit; and drilling the wellbore with the drill string.

* * * * *